US009546523B1

(12) United States Patent
Allen et al.

(10) Patent No.: US 9,546,523 B1
(45) Date of Patent: Jan. 17, 2017

(54) COLLARS FOR MULTIPLE TUBULARS

(71) Applicant: VIV Solutions LLC, Richmond, TX (US)

(72) Inventors: Donald Wayne Allen, Richmond, TX (US); William Andrew West, Friendswood, TX (US); Julie Ann Dehne, Cypress, TX (US)

(73) Assignee: VIV Solutions LLC, Richmond, TX (US)

( * ) Notice: Subject to any disclaimer, the term of this patent is extended or adjusted under 35 U.S.C. 154(b) by 0 days.

(21) Appl. No.: 14/728,755

(22) Filed: Jun. 2, 2015

Related U.S. Application Data

(60) Provisional application No. 62/008,678, filed on Jun. 6, 2014, provisional application No. 62/051,766, filed on Sep. 17, 2014.

(51) Int. Cl.

| | |
|---|---|
| ***E02D 5/60*** | (2006.01) |
| ***E21B 17/01*** | (2006.01) |
| ***B63B 21/50*** | (2006.01) |
| ***E21B 19/00*** | (2006.01) |
| ***E21B 17/10*** | (2006.01) |
| ***E21B 17/18*** | (2006.01) |

(52) U.S. Cl.
CPC ..... *E21B 19/002* (2013.01); *E21B 17/1078* (2013.01); *E21B 17/18* (2013.01)

(58) Field of Classification Search
CPC .. E21B 17/01; E21B 17/012; B63B 2021/504; B63B 21/663
USPC ..... 405/211, 212, 216
See application file for complete search history.

(56) References Cited

U.S. PATENT DOCUMENTS

| | | | | |
|---|---|---|---|---|
| 3,705,432 | A * | 12/1972 | Watkins, Jr. | F16L 1/24 248/230.1 |
| 4,102,142 | A * | 7/1978 | Lee | F16L 1/24 405/171 |
| 4,398,487 | A * | 8/1983 | Ortloff | B63B 1/32 114/243 |
| 4,437,791 | A * | 3/1984 | Reynolds | E21B 17/01 403/386 |
| 4,474,129 | A | 10/1984 | Watkins et al. | |
| 4,527,928 | A * | 7/1985 | Rutherford | E02B 17/0017 405/195.1 |
| 5,018,471 | A | 5/1991 | Stevens | |
| 6,010,278 | A | 1/2000 | Denison et al. | |
| 6,048,136 | A * | 4/2000 | Denison | E21B 17/01 114/243 |
| 6,347,911 | B1 | 2/2002 | Blair et al. | |
| 6,896,447 | B1 | 5/2005 | Taquino | |

(Continued)

FOREIGN PATENT DOCUMENTS

WO WO-2008087372 7/2008

*Primary Examiner* — James G Sayre
(74) *Attorney, Agent, or Firm* — Blakely Sokoloff Taylor & Zafman LLP

(57) ABSTRACT

A collar for axially positioning a vortex-induced vibration (VIV) suppression device along a tubular is disclosed. The collar has an annular body portion and a plurality of support members extending in a radial direction from the annular body portion. The support members are annularly spaced around the annular body portion such that gaps are formed between the support members, the gaps being dimensioned to receive an auxiliary tubular positioned external to a main tubular around which the annular body portion is positioned.

20 Claims, 12 Drawing Sheets

(56) References Cited

U.S. PATENT DOCUMENTS

| | | | | |
|---|---|---|---|---|
| 6,948,884 | B2 * | 9/2005 | Xu | E21B 17/01 405/211 |
| 7,017,666 | B1 | 3/2006 | Allen et al. | |
| 7,458,752 | B2 | 12/2008 | Esselbrugge et al. | |
| 7,845,299 | B2 | 12/2010 | Masters et al. | |
| 8,628,275 | B1 * | 1/2014 | Trader | E02B 17/0034 405/211 |
| 2002/0146287 | A1 | 10/2002 | Allen et al. | |
| 2003/0000152 | A1 | 1/2003 | Ryan | |
| 2003/0074777 | A1 * | 4/2003 | McMillan | B63B 21/502 29/428 |
| 2004/0175240 | A1 * | 9/2004 | McMillan | F15D 1/10 405/211 |
| 2007/0104542 | A1 * | 5/2007 | Somerville | B63B 21/663 405/224.1 |
| 2008/0050181 | A1 | 2/2008 | Masters et al. | |
| 2008/0236469 | A1 | 10/2008 | Masters et al. | |
| 2009/0185868 | A1 | 7/2009 | Masters et al. | |
| 2010/0061809 | A1 | 3/2010 | Allen et al. | |
| 2010/0119308 | A1 | 5/2010 | Somerville et al. | |
| 2010/0150662 | A1 | 6/2010 | Allen et al. | |
| 2012/0292040 | A1 * | 11/2012 | Prescott | E21B 17/01 166/345 |

* cited by examiner

COLLARS FOR MULTIPLE TUBULARS

CROSS-REFERENCE TO RELATED APPLICATION

The application is a non-provisional application of co-pending U.S. Provisional Patent Application No. 62/008,678, filed Jun. 6, 2014 and U.S. Provisional Patent Application No. 62/051,766, filed Sep. 17, 2014, which are incorporated herein by reference.

FIELD

A collar for axially positioning a vortex-induced vibration (VIV) suppression device along a tubular. Other embodiments are also described herein.

BACKGROUND

A difficult obstacle associated with the exploration and production of oil and gas is management of significant ocean currents. These currents can produce vortex induced vibration (VIV) and/or large deflections of tubulars associated with drilling and production. VIV can cause substantial fatigue damage to the tubular or cause suspension of drilling due to increased deflections. Both helical strakes and fairings can provide sufficient VIV suppression, but can be slow and unsafe to install.

Most suppression devices are placed against the tubular. For example, helical strakes are typically clamped to the tubular, though in some cases the helical strake may have a spacer element to allow water flow under the strake for cathodic protection. Fairings typically have a small annulus between the fairing and the tubular, but are held in the same axial position by collars that are clamped to the tubular.

Fairings are typically free to weathervane (rotate) about the longitudinal axis of the tubular, and are supported by collars to keep them from sliding along the tubular axis more than desired. Often, collars are used at each end of the fairing to maintain the desired axial position.

A problem associated with collars is that it is difficult to design a collar that is able to accommodate other exterior or auxiliary tubulars outside of the main, or central, tubular. Since the collars are typically clamped tight against the main tubular, and since adjacent tubulars are often not designed to take the large forces associated with the tight collar, the presence of adjacent exterior tubulars is difficult to accommodate. This is especially true of drilling risers, which may have several lines running outside of the main pipe, for example choke and kill lines, booster lines, and other lines.

Sometimes fairings are installed on tubulars with buoyancy, insulation, or other coatings that contain the adjacent tubulars and allow the collar to be installed on a strong structure. Many fairing systems have been produced using collars that clamp around the buoyancy or insulation. However, and in particular for drilling systems, it is desirable to be able to use the same fairing system for both joints having buoyancy and joints for which the adjacent tubulars are exposed.

One solution is to build a very large collar and cut slots for adjacent tubulars positioned along the outer surface of the main tubular. Unfortunately, this is not very practical with the main tubular, which is large, and/or the distance between the main tubular and the adjacent tubulars is substantial. In addition, one important consideration is for the collars to be fast and/or inexpensive to install. Making the collars larger, however, is not very cost effective.

SUMMARY

The present invention consists of collar concepts for accommodating multiple tubulars. Representatively, the invention is directed to collars that can clamp onto a main tubular having one or more adjacent tubulars exterior to the main tubular. The adjacent tubulars may be, for example, auxiliary tubulars such as choke and kill lines or booster lines. The collar is further dimensioned to accommodate both single and multiple exterior tubulars for the same application. For example, the collar can accommodate a main tubular having a single exterior tubular or multiple exterior tubulars extending along the main tubular. The collar may also be dimensioned for use on a main tubular having no exterior tubulars. In addition, the collar has a relatively compact profile and is therefore relatively quick and inexpensive to install. In still further embodiments, the collar may be dimensioned to clamp directly to an adjacent tubular, for example, an auxiliary tubular.

In one embodiment, the invention is directed to a collar for axially positioning a vortex-induced vibration (VIV) suppression device along a tubular. The collar may include an annular body portion and a plurality of support members extending in a radial direction from the annular body portion. The support members may be annularly spaced around the annular body portion such that gaps are formed between the support members. The gaps may be dimensioned to receive an auxiliary tubular positioned external to a main tubular around which the annular body portion is positioned.

In another embodiment, the invention is directed to an apparatus for axially positioning a vortex-induced vibration (VIV) suppression device along a tubular. The apparatus may include an annular body portion dimensioned to encircle a main tubular at a fixed axial position and a plurality of support members. The plurality of support members may be attached to the annular body portion. The plurality of support members may form annularly spaced channels around the annular body portion, which are dimensioned to receive an auxiliary tubular positioned external to a main tubular around which the annular body portion is positioned.

In another embodiment, the invention is directed to a system for axially positioning a vortex-induced vibration (VIV) suppression device along a tubular. The system may include a plurality of collars annularly spaced around a main tubular. Each of the plurality of collars may be positioned at a fixed axial position around an auxiliary tubular positioned external to the main tubular and dimensioned to axially restrain a VIV suppression device positioned around the main tubular. It is further contemplated that, although VIV suppression devices are disclosed herein, in some embodiments, any type of device or structure that could benefit from being axially restrained along a tubular may be restrained by the plurality of collars.

The above summary does not include an exhaustive list of all aspects of the present invention. It is contemplated that the invention includes all apparatuses that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

Figure 1A:
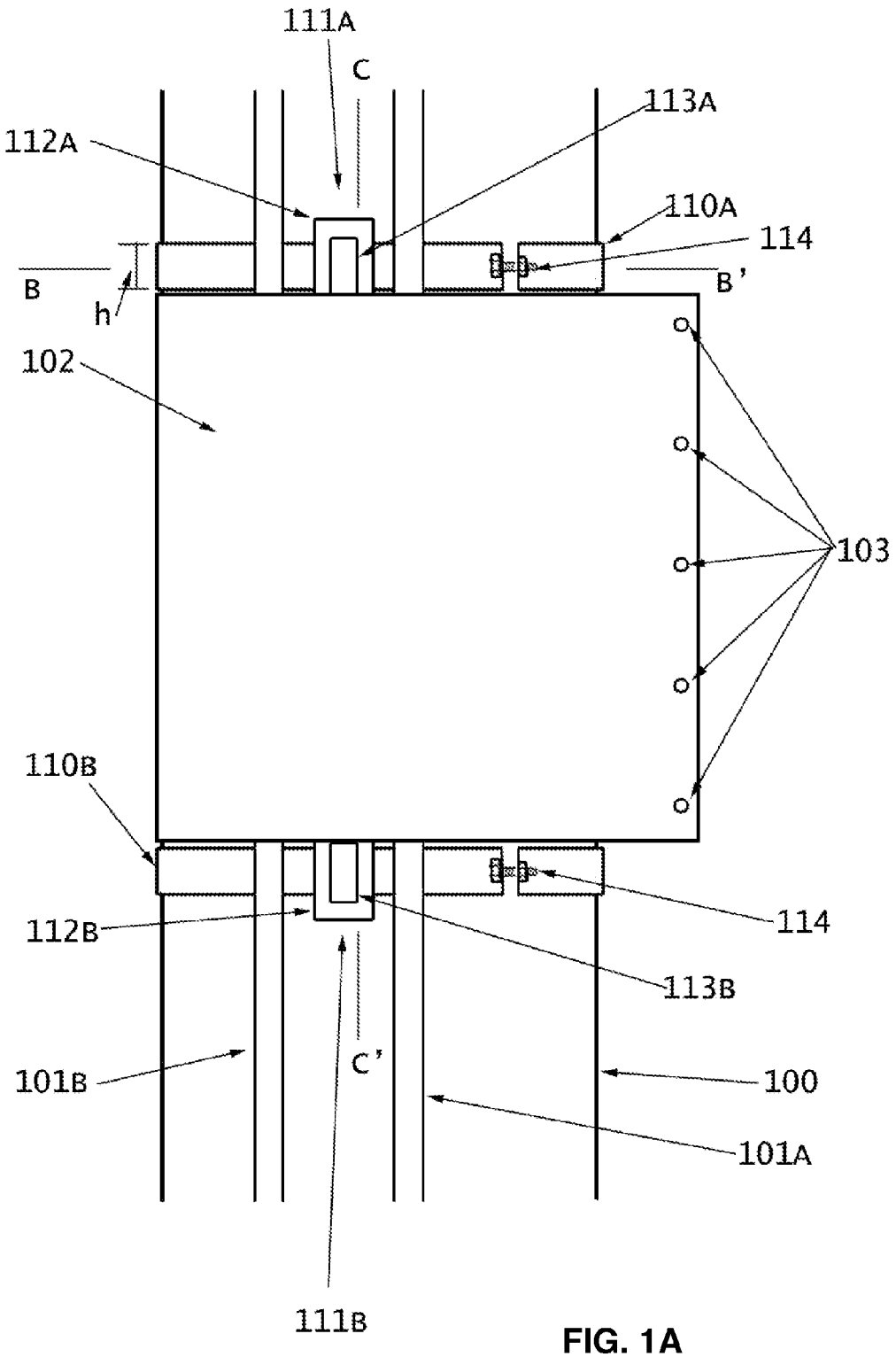
FIG. 1A is a side view of one embodiment of a VIV suppression device axially aligned along a main tubular having auxiliary tubulars.

Referring now to the invention in more detail, FIG. 1A presents a side view of a VIV suppression device 102 and two collars 111A, 111B that cover main tubular 100 and auxiliary tubulars 101A and 101B. In the illustrated embodiment, the VIV suppression device 102 is a fairing having, for example, a substantially triangular shaped tail, which is dimensioned to suppress VIV about tubular 100 by streamlining the current flow past the tubular. The fairing may have, for example, a clam-shell configuration such that it can be opened and closed around the tubulars. Tail fasteners 103 may be used to close the fairing around main tubular 100 and auxiliary tubulars 101A and 101B. It is to be understood, however, that although a fairing is illustrated, the VIV suppression device 102 may be any other type of device suitable for suppressing VIV about tubular 100, for example, a helical strake, a Henning device, a cylindrical or other shaped sleeve, or the like.

Collars 111A and 111B may be positioned at opposite ends of VIV suppression device 102 to help position device 102 at the desired axial location. Collars 111A, 111B may have a height (h) which is less than that of the associated VIV suppression device, for example, a height which is less than 50 percent of the height of the VIV suppression device, or less than 25 percent a height of the VIV suppression device or less than ⅛ a height of the VIV suppression device. Representatively, collars 111A, 111B may have a height of from about 1 inch to about 25 inches, for example, from about 2 to about 24 inches, or from about 6 to about 20 inches, or from 10 to about 15 inches. In other words, collars 111A, 111B are not intended to cover more of the tubular 100 than VIV device 102, rather they cover only a small portion of the tubular length which is exposed between VIV suppression devices positioned along tubular 100.

Collars 111A, 111B may include annular body portions 110A, 110B which are dimensioned to encircle tubular 100. Body portions 110A, 110B may, for example, be annular or ring shaped structures formed by one continuous structure or, in some embodiments, formed by segments, which when connected form a ring around tubular 100. Arms 113A, 113B may be attached to body portions 110A, 110B, respectively. Guide 112A is further attached to arm 113A and guide 112B is attached to arm 113B. Guides 112A, 112B and arms 113A, 113B may help to axially or radially support VIV suppression device 102 and therefore be considered support members. Collar fasteners 114 are used to attach collars 111A, 111B around tubular 100. For example, where collars 111A, 111B are made of segments, collar fasteners 114 are bolts, clamps, hinges, bands, or other fasteners that can be used to attach adjacent ring segments together. For example, fasteners 114 may include bolt plates welded on the ends of a band and bolts and nuts, which are used to secure each of the plates together. Alternatively, collar may be banded to the tubular at the time of installation in the absence of fasteners 114.

Again referring to FIG. 1A, VIV suppression device 102 (e.g. a fairing) is free to rotate around main tubular 100 and auxiliary tubulars 101A and 101B. Collars 111A, 111B, including guides 112A, 112B and arms 113A, 113B, help to restrain VIV suppression device 102 axially and radially as will be described in more detail in reference to FIGS. 1B-1C.

Fasteners 114 may be tightened to impose tension on segments of rings 110A, 110B so that collars 111A, 111B produce compression forces on main tubular 100. These compression forces, through friction, allow collars 111A, 111B to provide axial resistance to sliding. All collar components described herein may be used with other collar designs to enhance the functionality of this invention. For example, in some embodiments, collars 111A, 111B may be tightened around tubular 100 using a banding or other similar securing mechanism.

Still referring to FIG. 1A, any number of VIV suppression devices 102 and collars 111A, 111B may exist on main tubular 100 and/or auxiliary tubulars 101A and 101B. VIV suppression device 102 and collars 111A, 111B may be of any suitable size. For example, in embodiments where VIV suppression device 102 is a fairing, the fairing may be closed using tail fasteners 103 or any other suitable means including welding, chemical bonding, or clamping. Body portions 110A, 110B may be of any suitable thickness, width, or length and be made of any number of ring segments suitable to construct collars 111A, 111B. Typically, the diameter of collars 111A, 111B will be close to the outside diameter of main tubular 100.

Arms 113A, 113B may be of any suitable length, thickness, or width, but will typically be sufficiently long (i.e. length in the radial direction) to prevent a fairing tail from extending radially past arms 113A, 113B such that it axially falls off of the arms 113A, 113B. Guides 112A, 112B may be sufficiently tall to radially constrain VIV suppression device 102 even if it slides slightly between collars 111A, 111B. Thus, the minimum height of guides 112A, 112B will be partially dependent upon the distance between adjacent collars 111A, 111B. While FIG. 1A shows collar fasteners 114 used to connect adjacent segments of ring shaped body portions 110A, 110B, other connection mechanisms may also be used. These include, but are not limited to, welding, clamps, and other ring segments or suitable structures.

Still referring to FIG. 1A, VIV suppression device 102, collars 111A, 111B, ring shaped body portions 110A, 110B, arms 113A, 113B, guides 112A, 112B, collar fasteners 114, and tail fasteners 103 may be made of any suitable material including, but not limited to, plastics, metals, composites, wood, fiberglass, and synthetics.

Figure 1B:
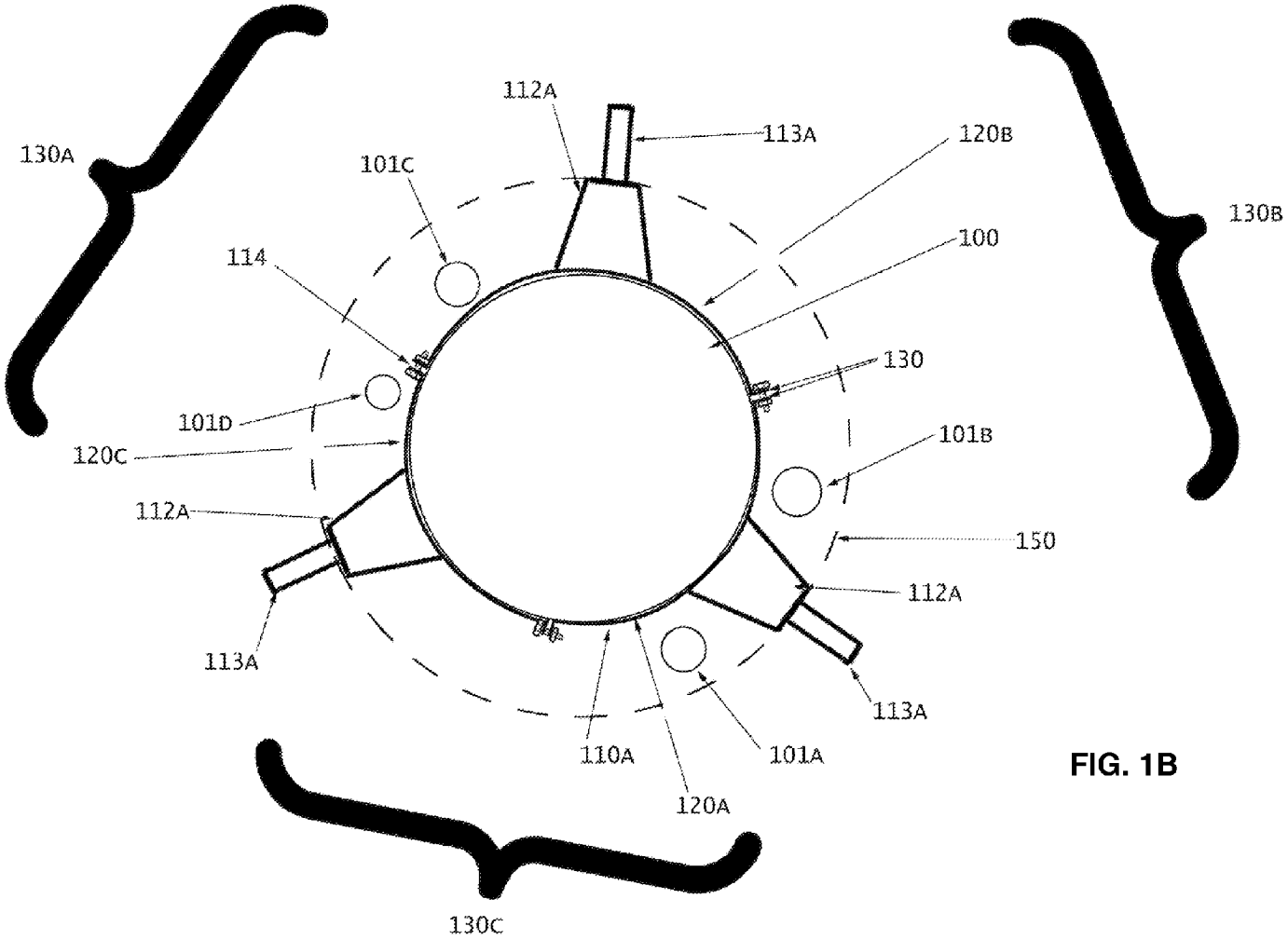
FIG. 1B is a top cross section along line B-B' of FIG. 1A.

Referring now to FIG. 1B, this figure is a cross section along line B-B' of FIG. 1A and shows main tubular 100 with adjacent auxiliary tubulars 101A, 101B, 101C, and 101D. From this view, it can be seen that body portion 110A includes ring segments 120A, 120B, 120C. Each of ring segments 120A, 120B and 120C includes arms 113A and guides 112A. Ends of adjacent ring segments 120A, 120B and 120C are connected by fasteners 114 which connect adjacent ring segments 120A, 120B, and 120C through flanges 130 formed at the ends of each of segments 120A, 120B and 120C. Flanges 130 may extend in a direction perpendicular to each of segments 120A, 120B and 120C such that flanges 130 adjacent to one another are substantially aligned and parallel with one another. The circular outline 150 illustrated in dashed lines represents the inner diameter, in other words, the inside rotation circle, of a VIV suppression device, for example device 102 (e.g. a fairing) which is positioned around tubular 100 and tubulars 101A, 101B, 101C and 101D and constrained radially by guides 112A. Thus, circular outline 150 shows that an inner surface of VIV suppression device 102 is spaced a distance (e.g. radially constrained) from the outer surface of tubular 100 such as by guides 112A positioned between tubular 100 and device 102.

Guides 112A, 112B and arms 113A, 113B may extend in a radial direction from body portions 110A, 110B of collars 110A, 110B, respectively. Guides 112A, 112B and arms 113A, 113B may be annularly spaced around body portions 110A, 110B such that they form channels or gaps 130A, 130B and 130C of a sufficient size to receive auxiliary tubulars 101A-101D positioned around tubular 100. In this embodiment, guides 112A, 112B and arms 113A, 113B extend from outer surfaces of body portions 110A and 110B (i.e. the surface facing away from the underlying tubular) therefore gaps 130A-130C are formed around the outer surface of body portions 110A and 110B. Auxiliary tubulars 101A-101D are, in turn, positioned over the body portions 110A, 110B within gaps 130A-130C. In other words, body portions 110A, 110B are positioned between tubular 100 and auxiliary tubulars 101A, 101B.

Again referring to FIG. 1B, any number of ring segments 120A, 120B, and 120C may be used to make up collars 111A, 111B. Any number of arms 113A and guides 112A may be used for the collar and any number of arms 113A and guides 112A may be present on each ring segment. The arms may be of any suitable shape, but will typically extend approximately radially outward from main tubular 100. The guides 112A may consist of a plate, part of the arm 113A, or any other suitable structure that may be attached to arm 113A or ring segment 120A, 120B, or 120C. Guides 112A may be of any suitable shape. Part of the guides 112A, 112B may extend inside of circle 150, or outside of circle 150, or both inside and outside of circle 150.

Still referring to FIG. 1B, ring segments 120A, 120B, and 120C, arms 113A, and guides 112A may be made of any suitable material including, but not limited to, plastics, metals, composites, wood, fiberglass, and synthetics.

Figure 1C:
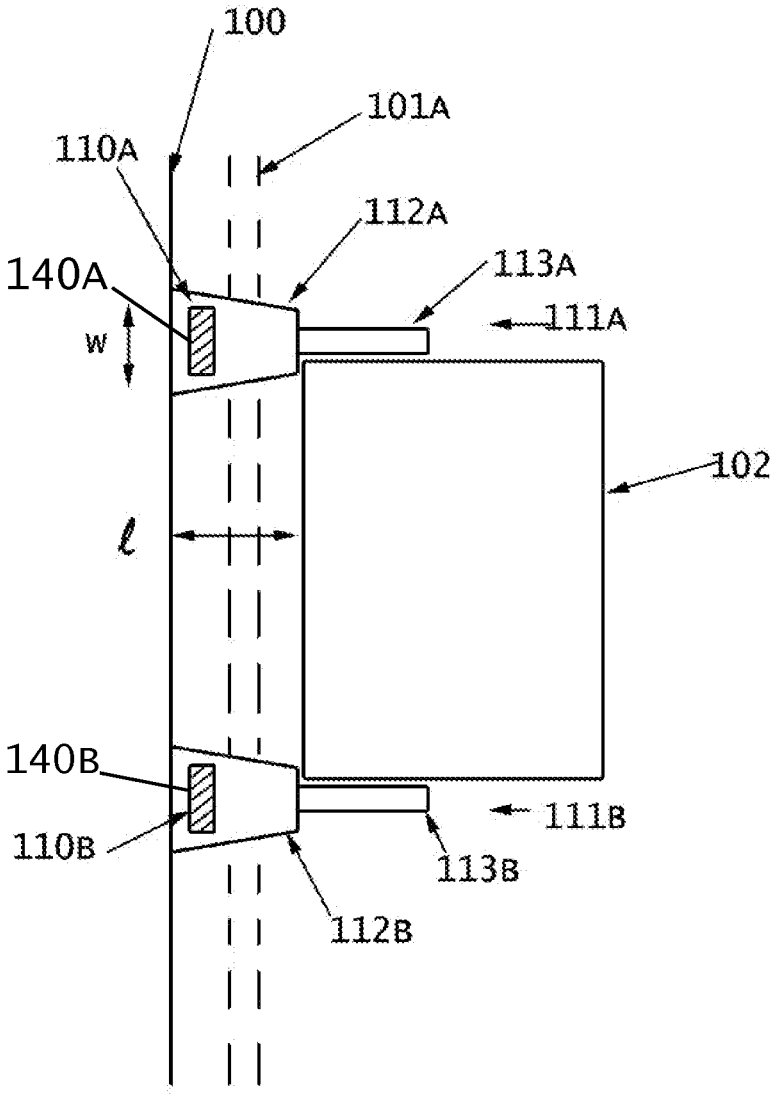
FIG. 1C is a side cross section along line C-C' of FIG. 1A.

Referring now to FIG. 1C, FIG. 1C illustrates a cross section along line C-C' of FIG. 1A. From this view, the relationship between guides 112A, 112B, arms 113A, 113B and VIV suppression device 102 can be more clearly seen. In particular, from this view, it can be seen that guides 112A, 112B are connected to tubular 100 by, for example, a collar body portion 110A, 110B that may extend through a slot 140A, 140B at the base of guides 112A, 112B. In this aspect, body portions 110A, 110B may be, for example, bands that can band the entire collar 111A, 111B to tubular 100. Guides 112A, 112B can be, for example, block shaped structures that are sufficiently thick, in other words have a width (w), such that portions of guides 112A, 112B extend into the inner annulus of the VIV suppression device 102. In other words, portions of guides 112A, 112B extend in an axial direction such that they are between VIV suppression device 102 and tubular 100. Guides 112A, 112B may also be sufficiently tall, or have a radial or length dimension (l), sufficient to space the VIV suppression device 102 a fixed distance from tubular 100. The distance may be equal to or greater than a diameter of the auxiliary tubular 101A between VIV suppression device 102 and tubular 100. Guides 112A, 112B therefore help to maintain a consistent radial spacing between tubular 100 and the VIV suppression device 102 and serve to minimize translation or shifting of VIV suppression device 102 in a radial direction with respect to tubular 100, which in turn provides further stability to the device.

Arms 113A, 113B extend radially from guides 112A, 112B, respectively. Arms 113A, 113B may have a narrower profile than guides 112A, 112B such that a pocket for receiving portions of VIV suppression device 102 is formed between each of collars 111A, 111B. In other words, each of collars 111A, 111B form stepped shape receiving areas within which top and bottom edges of VIV suppression device 102 can be positioned. The guides 112A, 112B therefore help to centralize the VIV suppression device 102 about tubular 100, in other words, hold device 102 at a fixed radial position with respect to tubular 100, while the arms 113A, 113B prevent VIV suppression device 102 from sliding axially along tubular 100. In other words, the VIV suppression device 102 can sit between guides 112A, 112B and arms 113A, 113B and rotate around tubular 100. Since the guides 112A, 112B are wider than arms 113A, 113B, only guides 112A, 112B, however, fit within the inner circumference of the VIV suppression device 102 and help to minimize device translation.

Figure 2A:
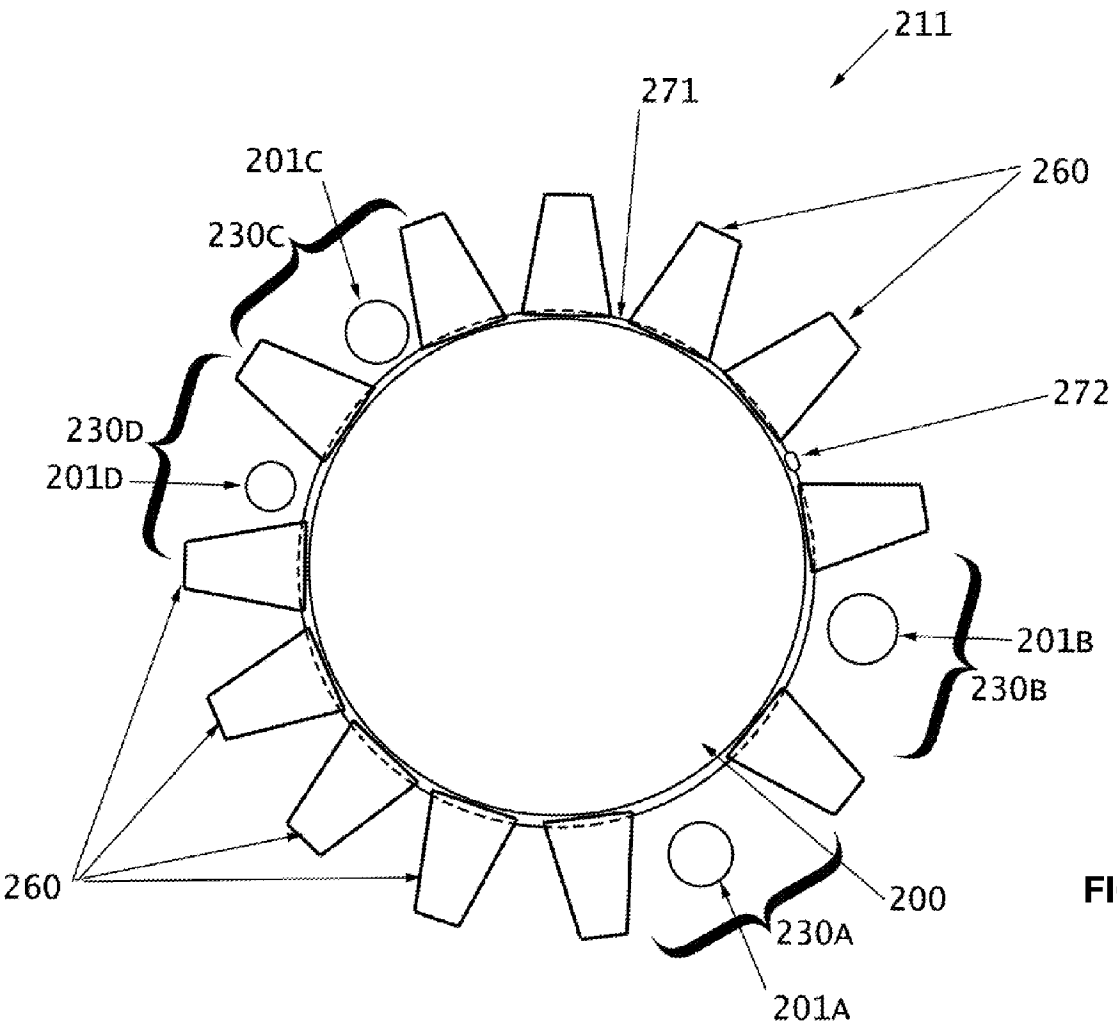
FIG. 2A is a top cross sectional view of another embodiment of a device for axially aligning a VIV suppression device along a main tubular having auxiliary tubulars.

Referring now to FIG. 2A, FIG. 2A illustrates a cross-sectional view of another embodiment in which a collar is positioned around a main tubular. Representatively, collar 211 may include support members or inserts 260 which extend radially from collar body portion 271. The collar body portion 271 in this case may be, for example, a ring or annularly shaped band. Body portion 271 has a similar diameter to that of main tubular 200 such that it is positioned on, and in contact with, the outer surface of main tubular 200 when it is closed around main tubular 200 as shown. Body portion 271 may be closed using band connection 272 (e.g. a clip, hinge, bolt, or the like). In this embodiment, auxiliary tubulars 201A, 201B, 201C, and 201D are external to main tubular 200 and body portion 271.

Again referring to FIG. 2A, support members or inserts 260 are attached and pressed against tubular 200 by the tension in body portion 271. These inserts 260 may be installed permanently or temporarily around main tubular 200. Functionally, inserts 260 allow for an outer annular member (e.g. another collar) or equivalent structure, to be placed around inserts 260 and tensioned to provide slipping resistance for the outer member. Auxiliary tubulars 201A, 201B, 201C, and 201D are therefore internal to any outer member (e.g. collar) placed around inserts 260. The ends of inserts 260 may have guide plates or other structural devices to assist with restraining fairings or other VIV devices that are placed on the outer member that is placed around inserts 260. Inserts 260 must be designed to withstand the structural forces imposed by the outer member as well as body portion 271.

Inserts 260 may extend in a radial direction from an outer surface of body portion 271 (i.e. the surface facing away from the underlying tubular). Inserts 260 may be annularly spaced around body portion 271 such that they form channels or gaps 230A, 230B, 230C and 230D of a sufficient size to receive auxiliary tubulars 201A-201D positioned around tubular 100. In this embodiment, gaps 230A-230D are formed around the outer surface of body portion 271. Auxiliary tubulars 201A-201D are therefore positioned over (i.e. along an outer surface) of the body portion 271 and within gaps 230A-230C.

Still referring to FIG. 2A, any number of inserts 260 may be used around main tubular 200. Inserts 260 may be of any suitable size or shape, and may all be of identical size and shape or may be of different size or shape (or material). For example, inserts 260 may have a substantially rectangular, square, triangular, cylindrical or other shape such that inserts 260 extend outwardly from tubular 200 a distance equal to our greater than the radius of auxiliary tubulars 201A-201D so that inserts 260 can support an outer member, for example, an outer collar, positioned around tubular 200 and auxiliary tubulars 201A-201D. Inserts 260 may be held in place by body portion 271 which may consist of a single band or multiple bands. Inserts 260 may also be held in place by additional or other means, including fastening inserts 260 to main tubular 200 or one or more structural members between inserts 260 and main tubular 200. Inserts 260 may also be connected to each other or have mechanisms that assist with attachment to an exterior member (e.g. an outer collar). Body portion 271 may pass through one or more inserts 260 (e.g. through a slot in the insert) or around one or more inserts 260 (e.g. the inserts pass through a slot in the band). Inserts 260 may also be attached to one or more auxiliary tubulars 201A, 201B, 201C, and 201D. Connector 272 may consist of any suitable connection mechanism including a clip, a weld, a fastener, or any combinations thereof suitable for connecting ends of portion 271 together. Body portion 271 may be of any suitable size and type.

Once more referring to FIG. 2A, inserts 260, body portion 271, and connector 272 may be made of any suitable material including, but not limited to, plastics, metals, composites, wood, fiberglass, and synthetics.

Figure 2B:
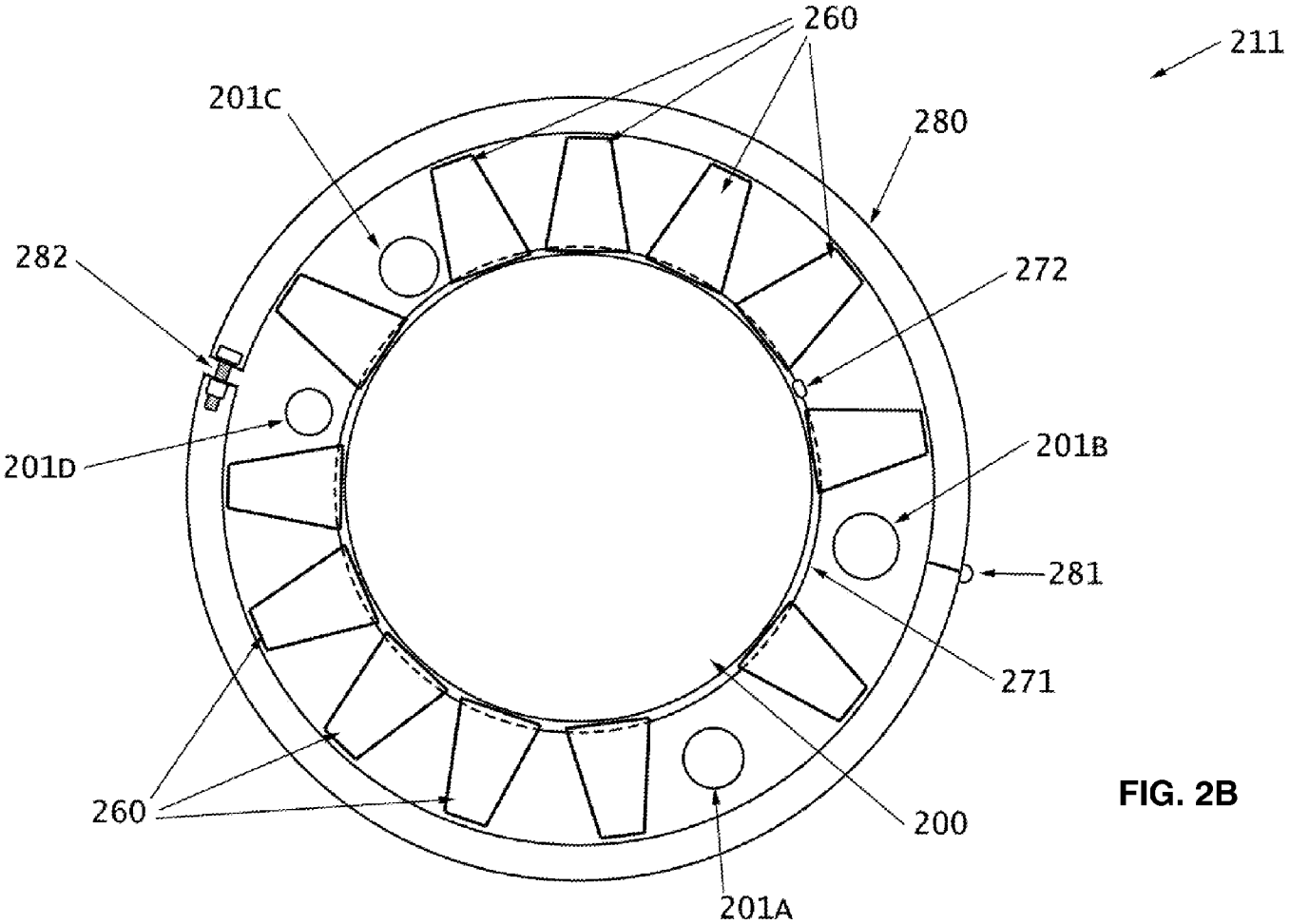
FIG. 2B is a top cross sectional view of the embodiment of FIG. 2A with an additional exterior device.

Referring now to FIG. 2B, FIG. 2B is a cross-sectional view showing the inserts attached to the main tubular as illustrated in FIG. 2A, and with an outer collar member present. Representatively, as discussed in reference to FIG. 2A, inserts 260 are placed around main tubular 200 and held in place by body portion 271. Body portion 271 is positioned around main tubular 200 and closed with connector 272. Auxiliary tubulars 201A, 201B, 201C, and 201D are external to main tubular 200. Outer collar 280 is placed around inserts 260. Outer collar 280 may include two semi-circular halves that are connected by hinge 281 on one side and fastener 282 on the opposite side. Outer collar 280 may have a height which is less than that of the associated VIV suppression device, for example, a height which is less than 50 percent of the height of the VIV suppression device, or less than 25 percent a height of the VIV suppression device or less than ⅛ a height of the VIV suppression device. Representatively, outer collar 280 may have a height of from about 1 inch to about 6 inches, for example, from about 2 inches to about 5 inches, or from 3 inches to 4 inches. In other words, outer collar 280 is not intended to cover more of the tubular 100 than the VIV device, rather they cover only a small portion of the tubular length which is exposed between VIV suppression devices positioned along tubular 100.

Again referring to FIG. 2B, inserts 260 are attached and pressed against tubular 200 by the tension in body portion 271. These inserts 260 may be installed permanently or temporarily around main tubular 200. Functionally, inserts 260 allow for an outer collar 280, or equivalent structure, to be placed around inserts 260 and tensioned to provide slipping resistance for the outer member. Auxiliary tubulars 201A, 201B, 201C, and 201D are therefore internal to any outer collar 280 placed around inserts 260. The ends of inserts 260 may have guide plates or other structural devices to assist with restraining fairings or other devices that are placed on collar 280 that is placed around inserts 260. Inserts 260 must be designed to withstand the structural forces imposed by the collar as well as body portion 271.

Still referring to FIG. 2B, outer collar 280 may include any number of segments. Adjacent segments may be connected by hinge 281, fastener 282, a band, or any other suitable mechanism or may not be connected at all. In FIG. 2B, the concept illustrates a collar insert system where inserts 260 are attached to the main tubular and not necessarily outer collar 280 itself, though inserts 260 may also be attached or connected to outer collar 280.

Figure 3:
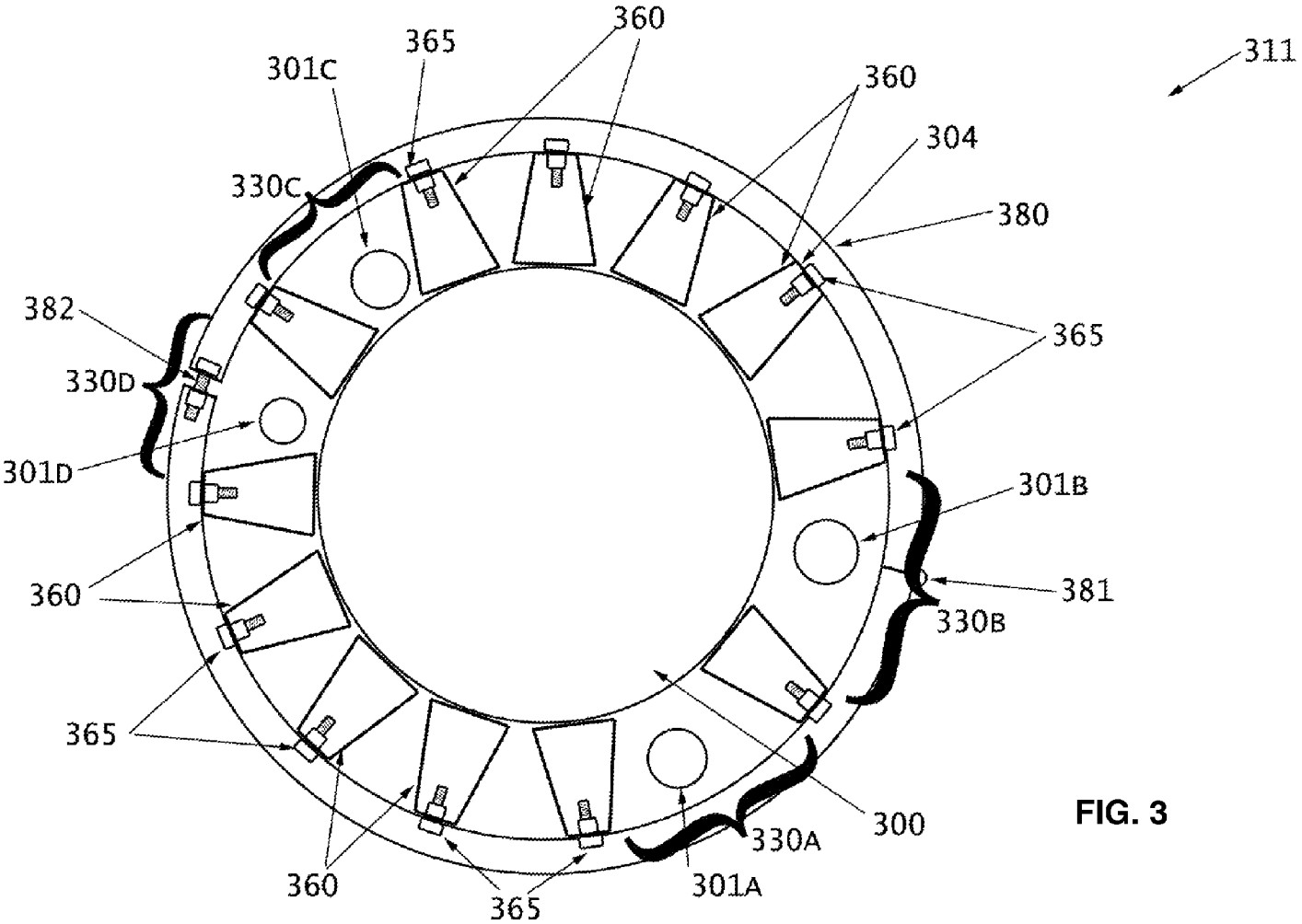
FIG. 3 is a top cross sectional view of another embodiment of a device for axially aligning a VIV suppression device.

Referring to FIG. 3, FIG. 3 illustrates a cross-sectional view of another embodiment in which inserts are attached to an annular member such as a collar. Representatively, in this embodiment, collar 311 includes support members or inserts 360, which are similar to the inserts previously discussed in reference to FIGS. 2A-2B, and external auxiliary tubulars 301A, 301B, 301C, and 301D located around main tubular 300. Inserts 360 are connected to an annular body member 380 dimensioned to encircle tubular 300 through fasteners 365. For example, inserts 360 include an inner end 302 and an outer end 304. The inner end 302 faces tubular 300 while outer end 304 faces annular body member 280. Fasteners 365 may be inserted through annular body member 380 and the adjacent insert end (i.e. outer end 304) so that inserts 360 are attached to the inner surface of the body portion of annular body member 380. In other words, inserts 360 are between collar 380 and tubular 300. Annular body member 380 is placed around inserts 360. Annular body member 380 may include two halves that are connected by hinge 381 on one side and fastener 382 on the opposite side. It should be understood that although an annular body member 380 having two halves hinged together is shown, in other embodiments, the annular body member 380 may be formed by more than two sections or halves, for example, three or more separate sections that, when attached together (e.g. bolted or hinged), form an annular member.

Again referring to FIG. 3, inserts 360 may be connected to annular body member 380 by fasteners 365 or by any suitable means, including welding, chemical bonding, or by any combination of methods. Inserts 360 may extend in a radial direction from an inner surface of annular body member 380 (i.e. the surface facing toward the underlying tubular). Inserts 360 may be annularly spaced around the annular body member 380 such that they form channels or gaps 330A, 330B, 330C and 330D of a sufficient size to receive auxiliary tubulars 201A-201D positioned around tubular 300. In this embodiment, gaps 330A-330D are formed around the inner surface of annular body member 380.

Figure 4A:
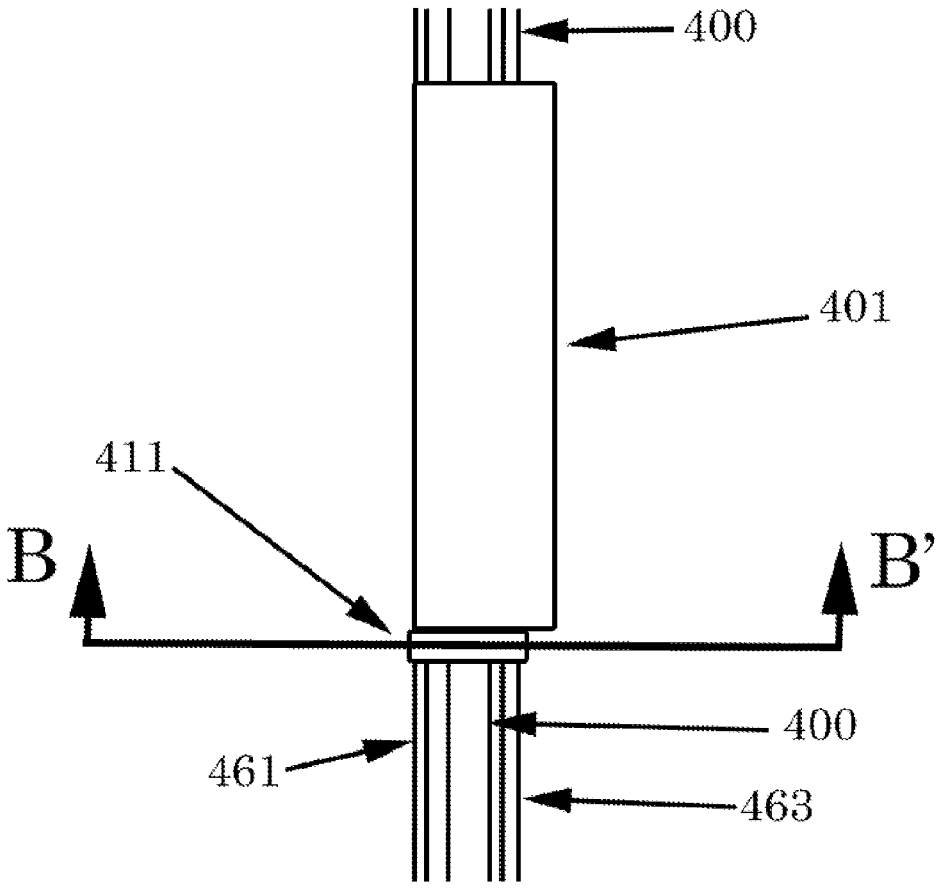
FIG. 4A is a side view of one embodiment of a VIV suppression device axially aligned along a main tubular.

FIG. 4A is a side view of one embodiment of a VIV suppression device axially aligned along a main tubular. Referring now to the invention in more detail, FIG. 4A illustrates a main tubular 400 with a collar 411 positioned around tubular 400 and axially supporting VIV suppression device 401, which rests on the collar 411. In addition, auxiliary tubulars 461 and 463 are shown positioned external to main tubular 400. The VIV suppression device 401 may be free to rotate about tubular 400 and auxiliary tubulars 461, 463 while collar 411 is clamped to tubular 400. In on embodiment, VIV suppression device 401 may be a fairing.

Figure 4B:
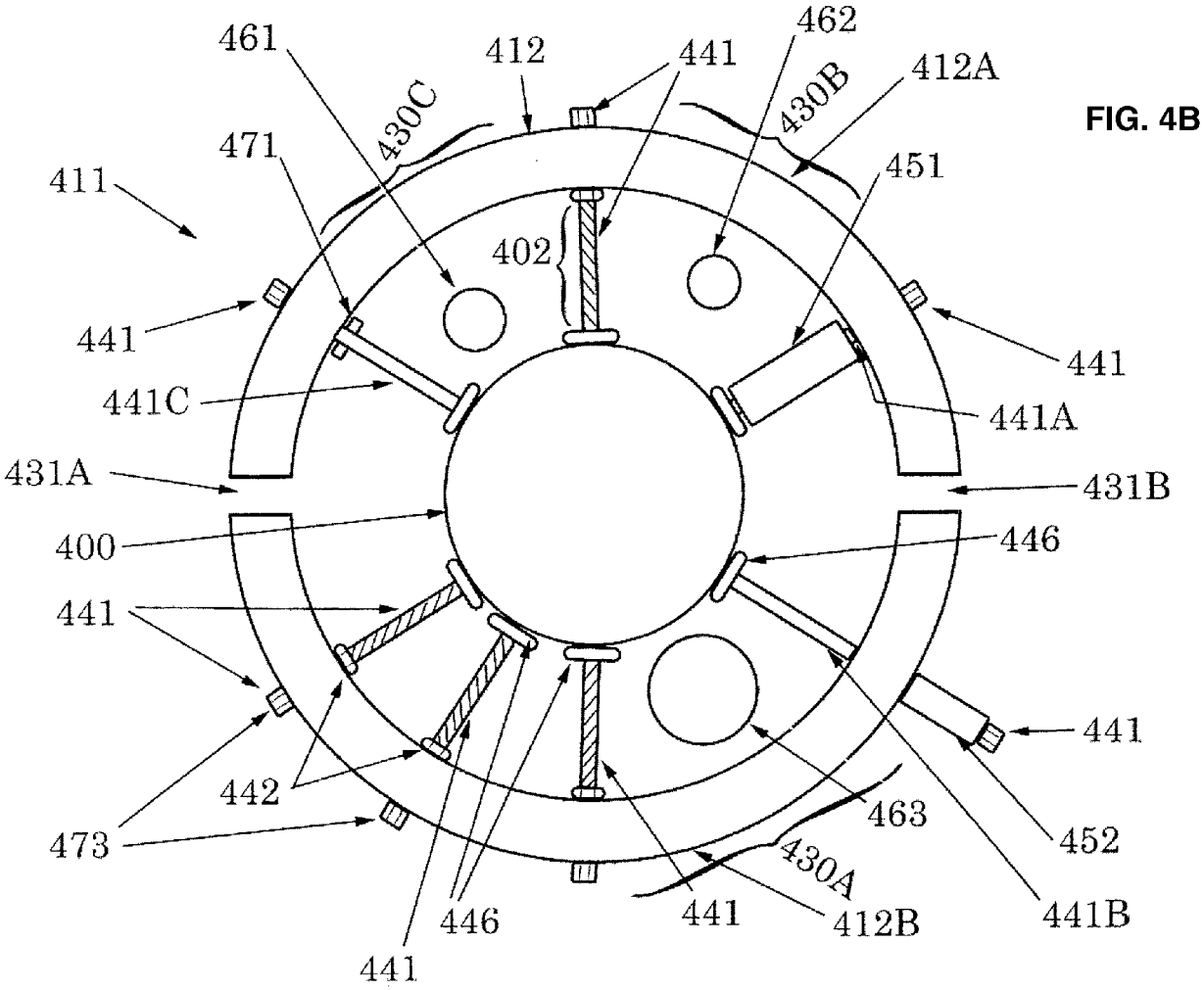
FIG. 4B is a top cross-sectional view along line B-B' of FIG. 4A.

FIG. 4B is a cross-section along line B-B' of FIG. 4A. In particular, FIG. 4B illustrates a cross-sectional view of another embodiment in which inserts are attached to a collar. This figure shows collar 411 positioned around tubular 400. In one embodiment, collar 411 includes annular body member 412 having sections or halves 412A and 412B, which are separated by openings 431A and 431B. In some embodiments, halves 412A, 412B may be hinged together at one of openings 431A, 431B and include a fastener at the other of openings 431A, 431B to close and secure halves 412A, 412B around tubular 400. Auxiliary tubulars 461, 462, and 463 are positioned adjacent to tubular 400. Annular body 412 may have support or extension members 441 that radially space annular body 412 a distance from the outer surfaced of tubular 400. Extension members 441 may be positioned through openings within annular body 412 such that one end of the extension members extends to the tubular 400 (i.e. faces tubular 400) while the other end extends out an outer surface of annular body 412 (i.e. faces away from tubular 400). Said another way, extension members 441 may extend through a thickness of annular body 412 and to tubular 400. In this aspect, extension members 441 may be radially positioned with respect to annular body 412 and tubular 100. Extension members 441 may be held in place by inner nuts 442, which are positioned around the extension members 441 near the inner surface of annular body 412 and outer nuts 473 that are positioned around extension members 441 near the outer surface of annular body 412. Extension members 441 may also have caps or blocks 446 attached to the ends facing tubular 400.

Extension members 441 may be annularly spaced around the annular body 412 such that they form channels or gaps 430A, 430B and 430C of a sufficient size to receive auxiliary tubulars 461, 462 and 463 positioned around tubular 100. In this embodiment, gaps 430A-430D are formed around the inner surface of annular body 412. Auxiliary tubulars 461, 462 and 463 are therefore positioned within gaps 430A-430C between annular body 412 and tubular 400.

In some embodiments, one or more of extension members 441, for example, extension member 441A may have an inner spring 451 on it. In still further embodiments, one or more of extension members 441, for example extension member 441B may have an outer spring 452 on it. In other embodiments, one or more of extension members 441, for example, extension member 441C, may have a cross pin 471 through it to help hold extension member in place relative to section or half 412A. Although each of the inner spring 451, outer spring 452 and cross pin 471 are illustrated on different extension members, it is contemplated that one or more of these features may be combined on the same extension member, or in any other combination, to facilitate adjustment of the collar 411 about tubular 100 and auxiliary tubulars 461 462, 463.

Representatively, halves 412A and 412B may be tightened and/or adjusted using any one or more of a combination of inner spring 451, outer spring 452, cross pin 471, inner nuts 442 or outer nuts 473, or other bolt, nut, band, or clamp configuration. Representatively, in one embodiment, extension member 441 is inserted through the opening in the annular body 412 and turned so that it advances toward tubular 400 until the section 402 of extension member 441 is of the desired length. The desired length may be, for example, a length similar to or equal to the space between the inner surface of annular body 412 and the outer surface of tubular 400. The desired length of extension member 441 may be fixed by, for example, tightening inner nut 442 and outer nut 473 against the inner and outer surfaces of annular body 412, respectively. Other hardware such as nuts and washers may be used on either side of the annular body 412 from nut 442 and/or nut 473.

In embodiments where an inner spring 451 is positioned around the extension member (e.g. extension member 441A) when the annular body 412 is tightened against tubular 400, inner spring 451 is compressed. This allows the annular body 412 to accommodate changes in the diameter of tubular 400 after installation, such as changes in diameter due to hydrostatic compression.

In embodiments where outer spring 452 is positioned around the extension member 441B, when extension member 441B is tightened against tubular 400 then outer spring 452 is compressed. The presence of outer spring 452 may further allow annular body 412 to accommodate changes in the diameter of tubular 400 after installation, such as changes in diameter due to hydrostatic compression. Note that any type of spring suitable to provide a compressive force may be used.

In some embodiments, extension member 441 may have holes or a slot for cross pin 471 so that when the collar is compressed it pushes against cross pin 471 and then pushes extension member 441 against the block 446 and against the tubular 400.

Caps or blocks 446 may, for example, be threaded onto the end of extension member 441. In this aspect, each of blocks 446 presses on the outer surface of tubular 400. Blocks 446 may be made of a relatively resilient material, for example a resilient plastic, such that it can expand or contract to accommodate a diameter change of tubular 400. The resiliency of blocks 446 help to maintain a consistent tension between the surrounding annular body 412 and tubular 400 so that annular body 412 can be maintained at the same axial position and will not become loose and slide to a different axial position along tubular 400. Caps or blocks 446 may have a nut molded into them or may simply be drilled and tapped to receive extension members 441. Extension members 441 may be fully or partially threaded and may simply consist of a rod, tube, or turnbuckle. Inner spring 451 and outer spring 452 may be coiled springs or made of compressible material such as an elastomer.

Still referring to FIG. 4B, extension members 441 may be made in any suitable shape, and while their lengths may be approximately equal, they are not restricted to be equal Annular body 412 may further be divided into any number of sections or halves 412A and 412B, for example the annular body 412 may be made up of thirds or quarters. Any number and size of auxiliary tubulars 461, 462, and 463 may be present or no auxiliary tubulars may be present. Blocks 446 may be of any suitable size and shape and may optionally be curved on the face adjacent to tubular 400. Each of blocks 446 may, in some embodiments, consist of multiple parts. Cross pin 471 may be of any suitable size or shape and may have other attachments to it such as a head, cotter pin, or split pin. Any type of pin may be used for cross pin 471.

Inner spring 451 and outer spring 452 may be of any suitable size and shape and may surround (or partially surround) the relevant extension members (e.g. members 441A or 441B) or may be in-line with the relevant bolt. Inner spring 451 and outer spring 452 may also be attached directly to the collar or tubular and not directly to a bolt, nut, or block. Inner spring 451 and outer spring 452 may also be attached directly to blocks 446.

Extension members 441 may be pressed against other structures such as auxiliary tubulars 461, 462, and 463 and therefore do not necessarily need to be pressed against tubular 100. Other structures may be substituted for one or more extension members 441 such as serrated pins or fixed struts. The extension members may all be the same size and structure, or a combination of different extension member configurations may be attached to the annular body. Similarly, different spring types, blocks 446, or other hardware may be mixed and matched for a single collar or for a single collar half 412A or 412B.

Still referring to FIG. 4B, all components may be made of any suitable material including, but not limited to, metal, plastic, composite, wood, and synthetics. Each component may be made of the same material or each component may be made of a different material than one or more of the other components.

Figure 5:
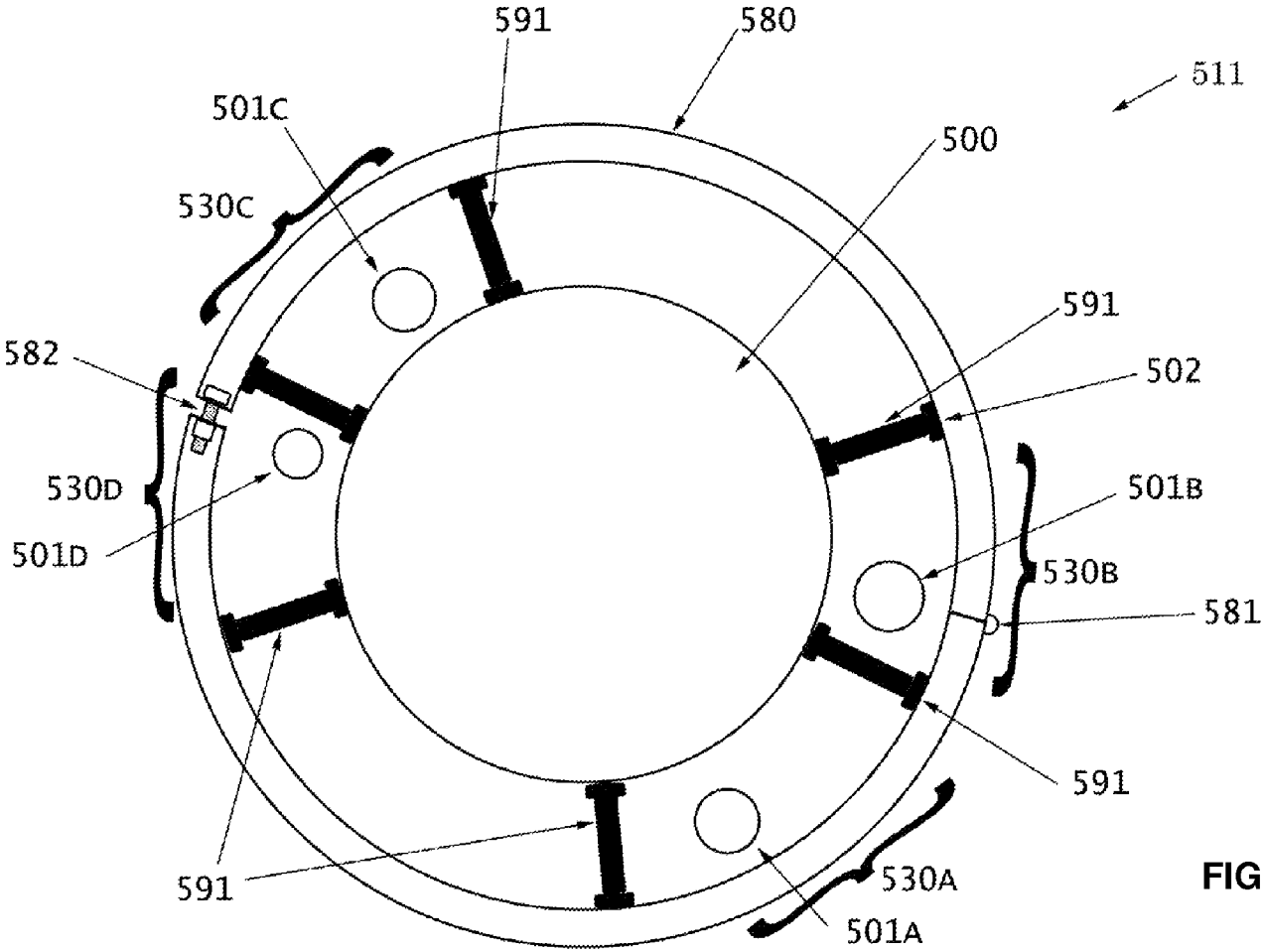
FIG. 5 is a top cross sectional view of another embodiment of a device for axially aligning a VIV suppression device.

Referring to FIG. 5, FIG. 5 illustrates a cross-sectional view of another embodiment in which inserts are positioned between an annular body member of a collar and a tubular. Representatively, in this embodiment collar 511 includes annular body member 580 and inserts 591 extending radially inward from member 580 to main tubular 500. Auxiliary tubulars 501A, 501B, 501C, and 501D also reside around main tubular 500 (in this invention, any number of auxiliary tubulars may be external to main tubular 500 and these tubulars may be of any reasonable cross-section or size; they may also be of the same size and shape or have different sizes and shapes). Annular body member 580 may be placed around supports 591. Annular body member 580 consists of two halves that are connected by hinge 581 on one side and fastener 582 on the opposite side.

Again referring to FIG. 5, this figure illustrates annular body member 580 is placed in tension by tightening fastener 582, which thereby imposes compression forces on inserts 591. These forces provide sliding resistance for annular body member 580. Any number of inserts 591 may be used and may be of any suitable shape or size. For example, in one embodiment, inserts 591 may be simple struts, such as "I" shaped struts having an outer end 502 attached to annular body member 580 and an inner end 504 which contacts and presses on tubular 500. Inserts 591 may be attached to main tubular 500, auxiliary tubulars 501A, 501B, 501C, 501D, annular body member 580, any combination thereof, or may not be attached at all and simply held in place by compression forces Annular body member 580 does not have to completely encircle main tubular 500 depending upon how it is attached to inserts 591 or if it is attached to other adjacent structures not shown in FIG. 5.

Inserts 591 may extend in a radial direction from an inner surface of body member 580 (i.e. the surface facing toward the underlying tubular). Inserts 591 may be annularly spaced around the body portion such that they form channels or gaps 530A, 530B, 530C and 2530D of a sufficient size to receive auxiliary tubulars 501A-501D positioned around tubular 500. In this embodiment, gaps 530A-530D are formed around the inner surface of body portion of collar 580. Auxiliary tubulars 501A-501D are therefore positioned within gaps 530A-530C between the body portion and tubular 500.

Inserts 591 may be made of any suitable material and may be connected to body member 580 or main tubular 500 by any suitable means, including welding, chemical bonding, or by any combination of methods.

Figure 6:
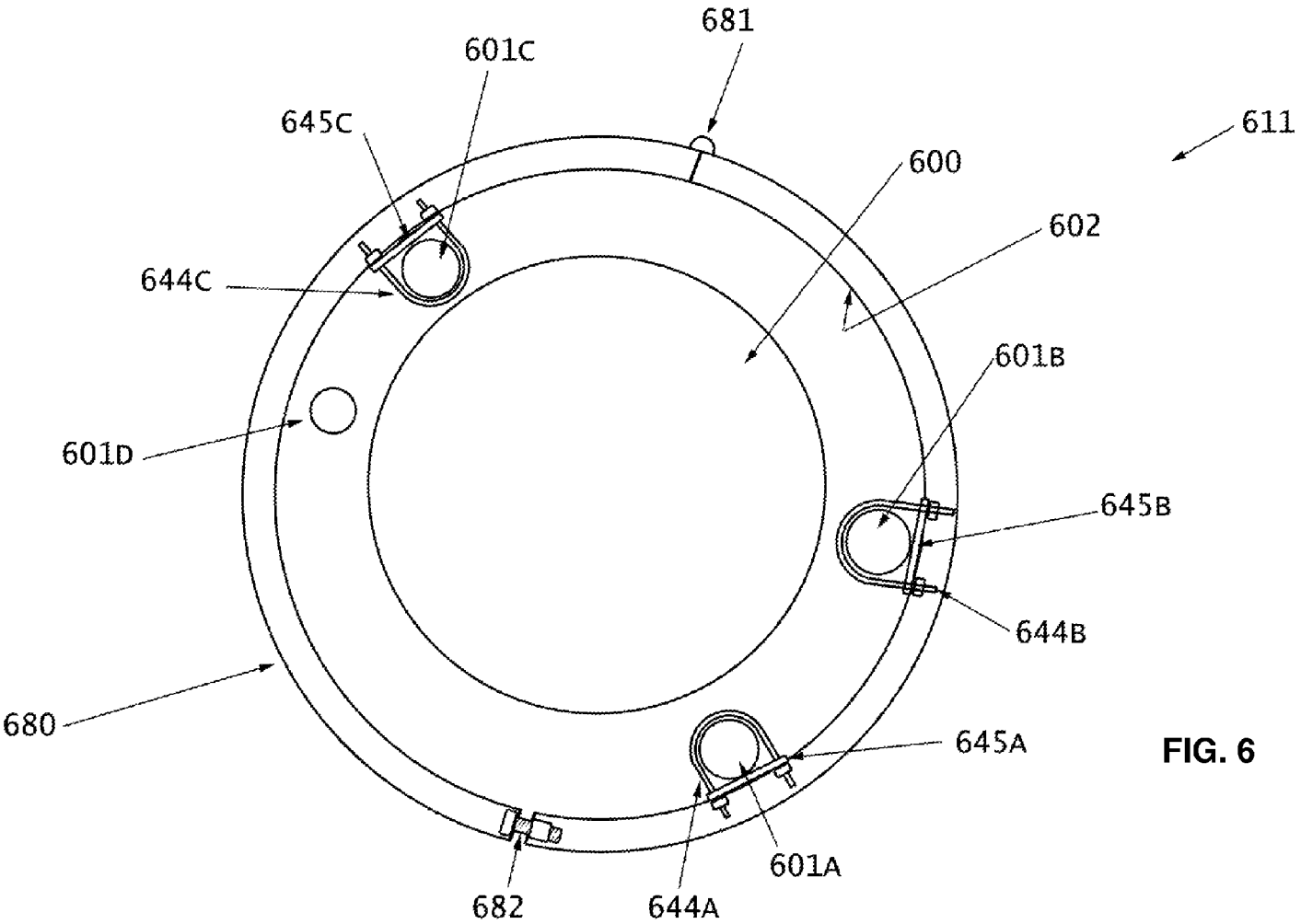
FIG. 6 is a top cross sectional view of another embodiment of a device for axially aligning a VIV suppression device.

Referring to FIG. 6, FIG. 6 illustrates a cross-sectional view of another embodiment of a collar attached to auxiliary tubulars. Representatively, in this embodiment, collar 611 includes annular body member 680 attached directly to each of auxiliary tubulars 601A, 601B, 601C and 601D, instead of main tubular 600. Representatively, auxiliary tubulars 601A, 601B, 601C, and 601D reside external to main tubular 600. Annular body member 680 surrounds auxiliary tubulars 601A, 601B, 601C, and 601D and main tubular 600. U-bolts 644A, 644B, and 644C extend inwardly from inner surface 602 of annular body member 280 and around each of auxiliary tubulars 601A, 601B, 601C, respectively, such that they connect body member 680 to auxiliary tubulars 601A, 601B, and 601C. Protective plates 645A, 645B, and 645C may be located between U-bolts 644A, 644B, and 644C and collar 680 to reduce stresses on auxiliary tubulars 601A, 601B, and 601C that might be caused by body member 680. Annular body member 680 consists of two halves that are connected by hinge 681 on one side and fastener 682 on the opposite side.

Again referring to FIG. 6, any number of U-bolts 644A, 644B, and 644C may be used on each auxiliary tubular and U-bolts may or may not be used on each auxiliary tubular. For example auxiliary tubular 601D is not connected to body member 680. U-bolts 644A, 644B, 644C and protective plates 645A, 645B, and 645C may be of any suitable size, shape or material.

Figure 7:
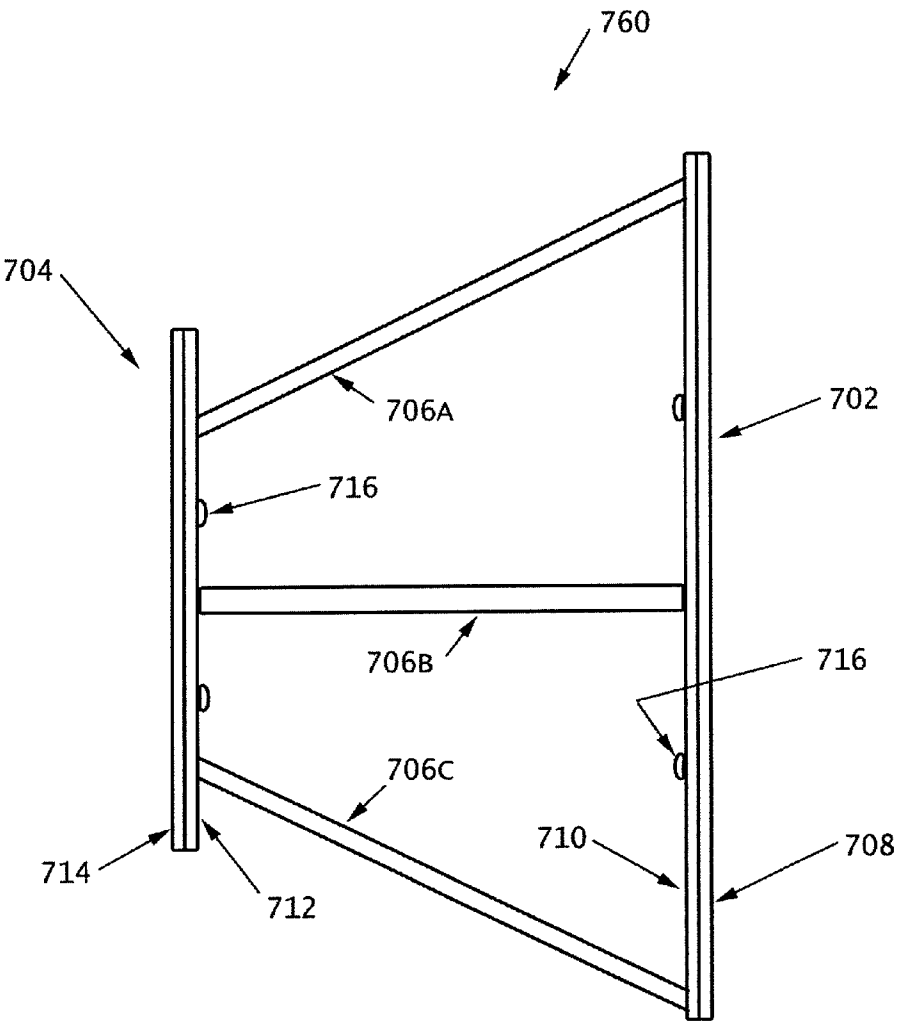
FIG. 7 illustrates a side cross sectional view of one embodiment of an insert member that can be connected to any of the previously discussed collars.

Referring to FIG. 7, FIG. 7 illustrates a side cross-sectional view of one embodiment of an insert member that can be used in connection with any of the previously discussed collar configurations. Representatively, from this view, it can be seen that insert member 760 may include an inner support member 702 and an outer support member 704 that are connected together by struts 706A, 706B and 706C. Inner support member 702 may be dimensioned such that it can be placed against an outer surface of a main tubular while outer support member 704 is dimensioned to be placed against the inner surface of the annular body portion of a collar positioned around the main tubular. In other words, insert member 760 is positioned between the main tubular and the collar such that it radially supports the collar a distance from the main tubular.

Inner support member 702 may include an outer plate 708 which interfaces with the surface of the main tubular and an inner plate 710 which is directly connected to one end of each of struts 706A-706C. Similarly, outer support member 704 may include an outer plate 714 which interfaces with the surface of the annular body of the collar and an inner plate 712 which is directly connected to the other end of each of struts 706A-706C. In some embodiments, inner plates 710, 712 and struts 706A-706C are integrally formed as a single structure and then attached to outer plates 708, 714 using connectors 716 (e.g. bolts, screws or the like). In addition, it should be understood that inner support member 702 and outer support member 704 may be formed by one single integrally formed plate instead of each being formed by two plates bolted together. In other words, outer plate 708 and inner plate 710 of inner support member 702 and outer plate 714 and inner plate 712 of outer support member 704, are each a single plate which do not require a bolt or fastening system. Once insert member 760 is assembled as shown, the outer support member 704 may be attached to the inner surface of the collar (i.e. the surface of collar facing the main tubular) using any suitable attachment mechanism, for example, bolts, screws or the like. The collar may have any number of insert members attached thereto. Collar can then be placed around a tubular such that it is radially spaced a distance from the tubular by inert member 760.

In some embodiments, inner support member 702 and outer support member 704 have a high aspect ratio such that they cover a larger surface area of the collar and/or tubular in the longitudinal direction than the axial direction. For example, inner support member 702 may have a height greater than its width such that it covers a larger area of the main tubular in a lengthwise direction than in a circumferential direction. Outer support member 704 may also have a height greater than its width. For example, inner support member 702 and outer support member 704 may have rectangular, or otherwise elongated, shapes. In some embodiments, inner support member 702 may have a greater height than outer support member 704. In still further embodiments, outer support member 704 may be wider than inner support member 702. In addition, inner support member 702 and outer support member 704 may be curved to a similar degree as that of the surface of the collar and tubular, respectively, such that they conform to the surface upon which they are attached. In addition, it should be noted that the increased height of insert member 760 with respect to a collar is advantageous in that it allows the collar to keep a fairing or other suppression device approximately centralized relative to the main tubular around which it is positioned.

Struts 706A-706C may be attached between inner support member 702 and outer support member 704 such that they are at an angle with respect to one another. In other words, struts 706A-706C are not parallel to one another, rather they fan out in a direction of inner member 702. For example, in some embodiments, the middle strut 706B is perpendicular to inner and outer support members 702, 704 and the outer struts 706A, 706C are at an angle with respect to middles strut 706B. Representatively, in some embodiments, the angle of middle strut 706B with respect to outer struts 706A, 706C is an acute angle, for example, around 35 degrees. The struts 706A-706C may be of any length sufficient to space the associated collar radially from the main tubular and around any auxiliary tubulars positioned along the main tubular (i.e. between the collar and the main tubular).

Figure 8:
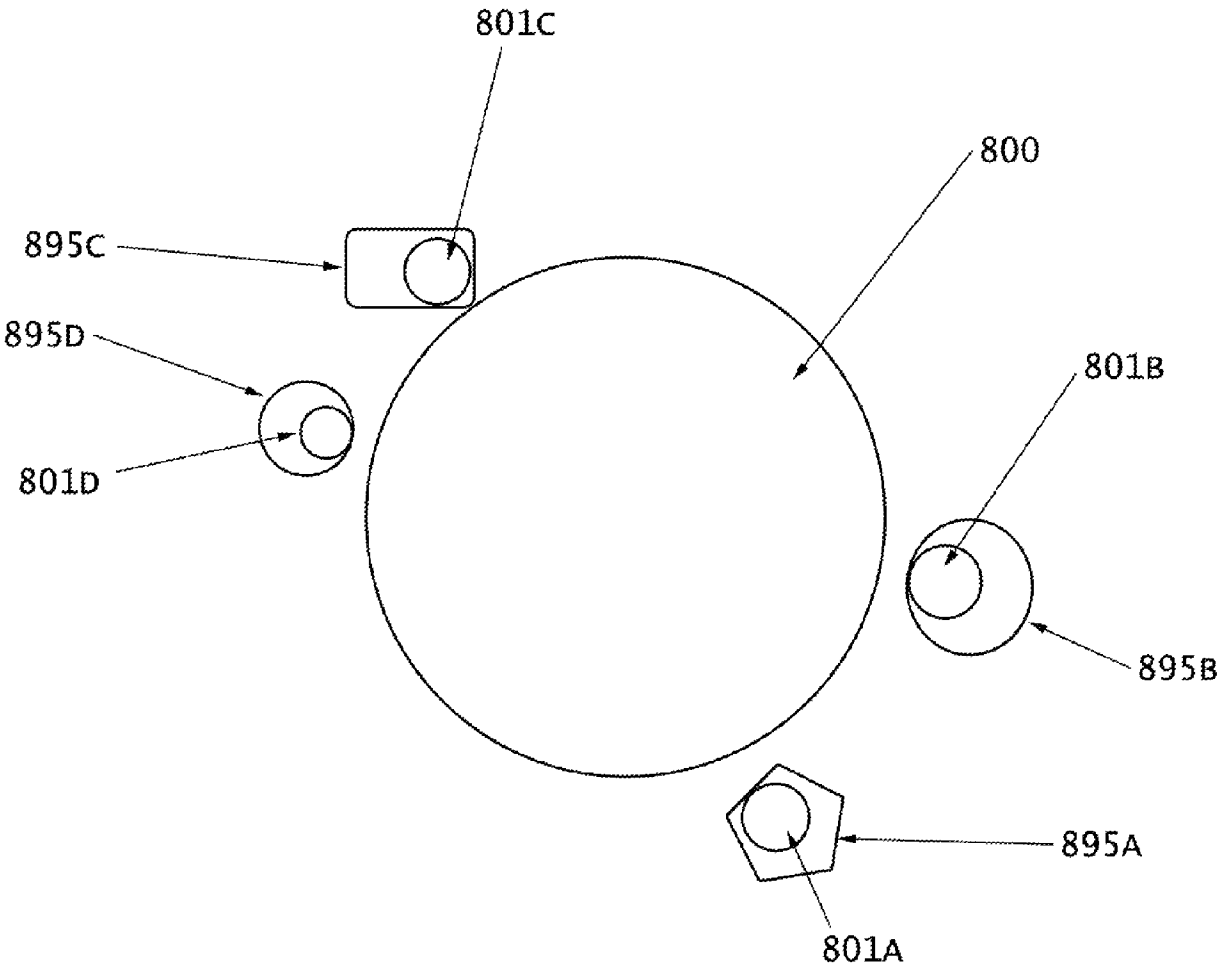
FIG. 8 is a top cross sectional view showing one embodiment of a main tubular and a set of auxiliary tubulars with local collars on the auxiliary tubulars.

Referring to FIG. 8, FIG. 8 illustrates a cross-sectional view of another embodiment of a main tubular with auxiliary lines and local collars positioned around the auxiliary lines. Representatively, auxiliary tubulars 801A, 801B, 801C, and 801D reside external to main tubular 800. A local annular body portion or collar 895A is attached to auxiliary tubular 801A, local collar 895B is attached to auxiliary tubular 801B, local collar 895C is attached to auxiliary tubular 801C, and local collar 895D is attached to auxiliary tubular 801D.

Again referring to FIG. 8, since auxiliary tubulars 801A, 801B, 801C, and 801D are attached to the main tubular 800 in other areas of the main tubular (not shown here, but usually at the end of a tubular joint), local collars 895A, 895B, 895C, and 895D provide a collar surface for a VIV suppression device (e.g., a fairing) that may be placed around auxiliary tubulars 801A, 801B, 801C, and 801D and thus restrained radially by auxiliary tubulars 801A, 801B, 801C, and 801D. The VIV suppression device (e.g. a fairing) will be restrained axially by local collars 895A, 895B, 895C, and 895D. Protective plates, covers, or other protective devices may be placed around auxiliary tubulars 801A, 801B, 801C, and 801D to keep the collar from damaging them (not shown).

Local collars 895A, 895B, 895C, and 895D may be of any suitable size and shape, and circular, rectangular, polygonal, and elliptical shapes are shown in FIG. 8 (they may also consist of arms or have other structures attached to them). Local collars 895A, 895B, 895C, and 895D may be attached to auxiliary tubulars 801A, 801B, 801C, and 801D by any suitable means, including bolting as shown in FIG. 8. Local collars 895A, 895B, 895C, and 895D may be made of any suitable material. Local collars 895A-895D may each be formed by a continuous sleeve-like structure such that they are threaded along each of auxiliary tubulars 801A-801D, or they may be clam-shell type structures which can be opened and closed around the respective tubular. Also, local collars 895A-895D may have a length or height, which is less than a length or height of the respective auxiliary tubular, or they may extend along the entire length of auxiliary tubulars 801A-801D.

The above aspects of this invention may be combined in any manner.

In broad embodiments, the present invention consists of a mechanism for obtaining thrust resistance, to support a VIV suppression device such as a fairing, for a main tubular with external lines.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For several of the ideas presented herein, one or more of the parts may be optional. The invention should therefore not be limited by the above described embodiment, method, and examples, but by all embodiments and methods within the scope and spirit of the invention.

What is claimed is:

1. A collar for axially positioning a vortex-induced vibration (VIV) suppression device along a tubular, the collar comprising:

an annular body portion dimensioned to be fixedly positioned along a tubular;

a plurality of guide members extending in a radial direction from the annular body portion, the guide members being annularly spaced around the annular body portion such that gaps are formed between the guide members, the gaps being dimensioned to receive an auxiliary tubular positioned external to a main tubular around which the annular body portion is positioned; and a support member positioned concentrically outward to the plurality of guide members, wherein the support member is dimensioned to contact a top end or a bottom end of a VIV suppression device positioned around a tubular and axially align the VIV suppression device along the tubular while allowing the VIV suppression device to rotate with respect to the annular body portion and the tubular.

2. The collar of claim 1 wherein the annular body portion comprises segments that in combination form a ring shaped structure.

3. The collar of claim 1 wherein each of the guide members extends radially outward from an outer surface of the annular body portion, and the guide members are dimensioned to space the VIV suppression device a distance from the main tubular so as to centralize a VIV suppression device about the main tubular.

4. The collar of claim 1 wherein the support member comprises a plurality of arm members extending radially outward from the plurality of guide members, the arm members dimensioned to axially align a VIV suppression device along the main tubular.

5. The collar of claim 1 wherein each of the guide members comprises:

an extension member having an end cap positioned at an end of the extension member facing the tubular, wherein the end cap is pressed against the tubular by the extension member to centralize the annular body portion about the main tubular.

6. The collar of claim 1 wherein each of the guide members are U shaped clamps which extend radially inward from the support member and are positioned around an auxiliary tubular.

7. The collar of claim 1 wherein the annular body portion is a first annular body portion, and the support member comprises a second annular body portion, wherein the guide members are positioned between the first annular body portion and the second annular body portion.

8. The collar of claim 1 wherein the guide members space the support member a distance from the main tubular.

9. The collar of claim 1 wherein the annular body portion comprises a height of from 1 inch to 24 inches.

10. An apparatus for axially positioning a vortex-induced vibration (VIV) suppression device along a tubular, the apparatus comprising:

a ring member dimensioned to encircle a main tubular at a fixed axial position and to support a VIV suppression device rotating around a main tubular;

a plurality of support members attached to the ring member, the plurality of support members forming annularly spaced channels between the ring member and the main tubular around which the ring member is positioned, the channels dimensioned to receive an auxiliary tubular positioned external to a main tubular around which the ring member is positioned; and a tightening member coupled to each of the plurality of support members, wherein the tightening member is configured to tighten the ring member and the plurality of support members against the main tubular around which the ring member is positioned.

11. The apparatus of claim 10 wherein the ring member is an outer ring member, the apparatus further comprises an inner ring member that is in contact with and fixedly secured around the main tubular.

12. The apparatus of claim 10 wherein each of the support members are dimensioned to space the VIV suppression device a distance from the main tubular so as to centralize a VIV suppression device about the main tubular.

13. The apparatus of claim 10 wherein each of the support members are dimensioned to axially align a VIV suppression device along the main tubular.

14. The apparatus of claim 10 wherein the ring member is inserted through a slot in each of the support members.

15. The apparatus of claim 10 wherein the support members are positioned concentrically inward to the ring member such that they are between the annular body portion and the main tubular.

16. The apparatus of claim 10 wherein each of the support members are positioned around an auxiliary tubular having a smaller diameter than the main tubular such that the ring member is attached to the auxiliary tubular at a desired axial position.

17. The apparatus of claim 10 wherein the support members are positioned radially inward to the ring member such that the annular body portion is spaced a distance from the main tubular.

18. The apparatus of claim 10 wherein the ring member comprises a height which is less than that of an associated VIV suppression device.

19. The collar of claim 10 wherein the tightening member comprises a spring member positioned between each of the plurality of support members and the ring member, and wherein compression of the spring member tightens the ring member and the plurality of support members against the main tubular.

20. The collar of claim 10 further comprising:

a band member dimensioned to encircle the ring member, wherein the band member is operable to be tightened around the ring member to compress the outer ring member around the main tubular.

* * * * *